US005687508A

United States Patent [19]

Fitzhenry, Jr. et al.

[11] Patent Number: 5,687,508

[45] Date of Patent: Nov. 18, 1997

[54] WATER RESISTANT DOOR ASSEMBLY

[75] Inventors: Edward T. Fitzhenry, Jr.; Aki Oi, both of Dublin, Ga.

[73] Assignee: YKK Corporation of America, Marietta, Ga.

[21] Appl. No.: 797,206

[22] Filed: Feb. 11, 1997

Related U.S. Application Data

[63] Continuation of Ser. No. 550,203, Oct. 30, 1995, abandoned.

[51] Int. Cl.[6] ..... E06B 1/70

[52] U.S. Cl. ..... 49/471; 49/380

[58] Field of Search ..... 49/471, 380

[56] References Cited

U.S. PATENT DOCUMENTS

| | | | |
|---|---|---|---|
| 3,410,027 | 11/1968 | Bates | 49/471 |
| 3,774,360 | 11/1973 | Hubbard et al. . | |
| 4,006,562 | 2/1977 | Belanger | 49/380 |
| 4,259,813 | 4/1981 | Winner et al. | 49/380 X |
| 4,310,991 | 1/1982 | Seely | 49/471 X |
| 4,831,779 | 5/1989 | Kehrli et al. | 49/471 |
| 5,018,307 | 5/1991 | Burrous et al. . | |
| 5,067,279 | 11/1991 | Hagemeyer . | |
| 5,283,977 | 2/1994 | Smith | 49/380 |
| 5,426,894 | 6/1995 | Headrick | 49/471 X |
| 5,446,937 | 9/1995 | Haskins . | |

FOREIGN PATENT DOCUMENTS

| | | | |
|---|---|---|---|
| 2145139 | 6/1979 | Georgia | 49/471 |
| 2128666 | 5/1984 | United Kingdom | 49/471 |
| 8908765 | 9/1989 | WIPO | 49/471 |

*Primary Examiner*—Carl D. Friedman
*Assistant Examiner*—Yvonne Horton-Richardson
*Attorney, Agent, or Firm*—Finnegan, Henderson, Farabow, Garrett & Dunner, L.L.P.

[57] ABSTRACT

A water resistant door assembly includes a door frame, a door hingedly mounted with the frame, and a threshold. The threshold has a height selected to be equal to or greater than a water head at a preselected design wind load pressure as a primary means to resist water intrusion. A series of gaskets, internal gutter troughs, and weep holes to the exterior of the door assembly provide a secondary means to resist water intrusion.

8 Claims, 7 Drawing Sheets

WATER RESISTANT DOOR ASSEMBLY

This application is a continuation of application Ser. No. 08/550,203, filed Oct. 30, 1995, now abandoned.

BACKGROUND OF THE INVENTION

1. Field of the Invention

The present invention relates to a water resistant entrance into a building, and more specifically to a water resistant door assembly.

2. Description of the Related Art

Conventional doors and windows may or may not include various water resistant means to try and prevent entry of wind-borne rain. These water resistant devices, when used, typically include gaskets in the door or window frame, weep holes on the interior of the door or window sill to collect water that gets past the door or window into the building interior, and a gutter extending to exterior weep holes to drain the collected water back to the exterior of the building.

During recent heavy storms and hurricanes in many coastal communities, the conventional doors and windows proved unsatisfactory. Rain and other wind-borne water and debris penetrated doors and windows in homes and commercial buildings, causing millions of dollars in damage to structures and furnishings.

Stricter building codes have subsequently been enacted in many of these communities, requiring new solutions to provide greater watertight integrity. At the same time, such provisions as the Americans With Disabilities Act also place requirements on door designs for certain buildings, including requiring sloped ramps to provide easier access.

SUMMARY OF THE INVENTION

The present invention relates to a water resistant door assembly that substantially obviates the above problems with conventional assemblies, by preventing leakage of water past a door or window, even in high wind conditions.

Additional features and advantages of the invention will be set forth in the description which follows, and in part will be apparent from the description, or may be learned by practice of the invention. The objects and advantages of the invention will be realized and attained by the apparatus particularly pointed out in the written description and claims below, as well as the drawings.

To achieve these and other advantages and in accordance with the purpose of the invention, as embodied and broadly described, a water resistant door assembly includes a door frame, a door hingedly mounted within the frame, the door having an interior side and an exterior side, and a threshold attached to a lower portion of said frame, the threshold having a height selected to be equal to or greater than a water head at a preselected design wind load pressure.

The water head is calculated as 0.192×water resistance pressure, with the water resistance pressure being calculated as 0.15×design wind load pressure, and the design wind load pressure being calculated as 0.00256×the square of a preselected design wind velocity.

It is preferred that the door is an out-swinging door, and further that the threshold is attached behind the exterior side of the door.

It is further preferred that the threshold includes a ramp having a slope of 1:12.

BRIEF DESCRIPTION OF THE DRAWINGS

The accompanying drawings, which are incorporated in and constitute a part of this specification illustrate preferred embodiments of the invention and, together with the description, serve to explain the objects, advantages and principles of the invention. In the drawings.

DETAILED DESCRIPTION OF THE PREFERRED EMBODIMENTS

Reference will now be made in detail to the present preferred embodiments of the invention, examples of which are illustrated in the accompanying drawings.

Figure 1:
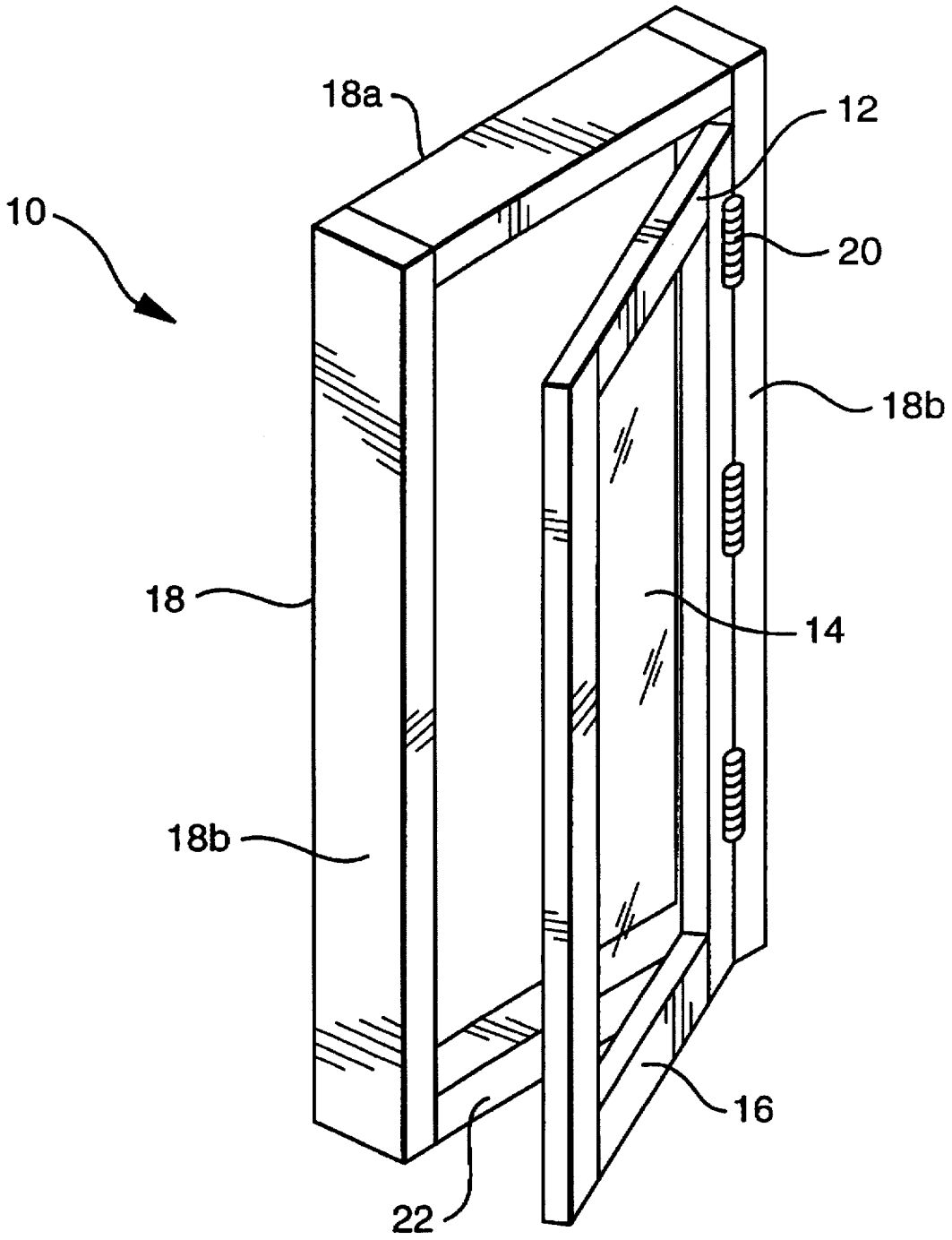
FIG. 1 is a graphic depiction of a water resistant door assembly.

A first embodiment of the water resistant door assembly of the present invention is shown in FIG. 1 and is designated generally by reference numeral 10. In accordance with the invention, the water resistant door assembly includes a door.

As embodied herein and referring to FIG. 1, door assembly 10 includes a door 12, having an interior side and an exterior side. Door 12 preferably includes a glazing unit 14 and a door leaf 16 to hold the glazing unit. Glazing unit 14 can be made of, e.g., glass, glass laminate, sealed double glass, plastic, aluminum, steel, and so forth.

In accordance with the invention, the water resistant door assembly further includes a door frame. As embodied herein, the door is hingedly mounted within a door frame. Referring to FIG. 1, a door frame 18 includes a header **18*a* and a pair of door jambs 18*b*. Door 12 is mounted within door frame 18 via hinges 20 provided between an edge of the door and the door jambs. In the preferred embodiments, door 12 swings outward in frame 18**.

In accordance with the invention, the water resistant door assembly further includes a threshold attached to a lower portion of the door frame, the threshold having a height selected to be equal to or greater than a water head at a preselected design wind load pressure. As embodied herein, and referring to FIGS. 2–4, a threshold 22 (which includes a sill, flashing and gutter) comprises a pair of interlocking threshold portions **22*a* and 22*b*. Threshold 22 connects to frame 18 proximate the interior side of door 12. The threshold 22** has a specifically selected height "h" that is raised above grade in order to resist water penetration and leakage through the door assembly. Height "h" is selected by dimensional and mathematical calculation to be greater than or equal to the height of a water head at design wind load pressures. This selection of the threshold height "h" is performed as follows.

Wind is defined as air in motion parallel to the ground. When air is moving in a horizontal direction at a given velocity (V), it exerts a static, dynamic, or design wind load pressure (P) on a stationary vertical plate perpendicular to the wind direction, that is proportional to the square of its velocity.

Wind striking the vertical plate is the same as wind blowing against a window or door. When rain is introduced into the moving air or wind, the static, dynamic, or design wind load pressure (P) will hold the rain water at a calculable height or water head (WH) against the face of the plate, window or door. Since water leakage is objectionable and most often unacceptable to building occupants, it is necessary to design products that will resist water penetration during adverse weather conditions. It is a generally accepted industry and building code practice to calculate the water resistance pressure (WRP) equal to fifteen percent (15%) of the positive design wind load pressure (P) under full service loads, but never less than a wind velocity of 33.4 MPH.

In accordance with the present invention, threshold 22 is designed to resist the penetration of wind driven rain at a defined wind velocity (V), design wind load (P), and water resistance pressure (WRP). The formulas for determining water head (WH) and threshold height "h" are as follows:

| | |
|---|---|
| $P = 0.00256 \times V^2$ | Where V = wind velocity in MPH |
| WRP = 15% P | Where P = design wind load in PSF |
| WH = 0.192 WRP | Where WPR = water resistance pressure in PSF |
| | Where WH = water head in inches of $H_2O$ |
| | Where MPH = miles per hour |
| | Where PSF = pound per square foot |

EXAMPLE

Determine a sill threshold height for a selected wind velocity equal to a 150 MPH storm.

$P=0.00256\times V^2$ $P=0.00256\times(150)^2$

P=57.6 PSF

WRP=15%×P

WRP=0.15×57.6

WRP=8.64 PSF

WH=0.192×WRP

WH=0.192×8.64

WH=1.66" $H_2O$

For this example the threshold height "h" should be selected at approximately 1.75", and at least 1.66".

Figure 2:
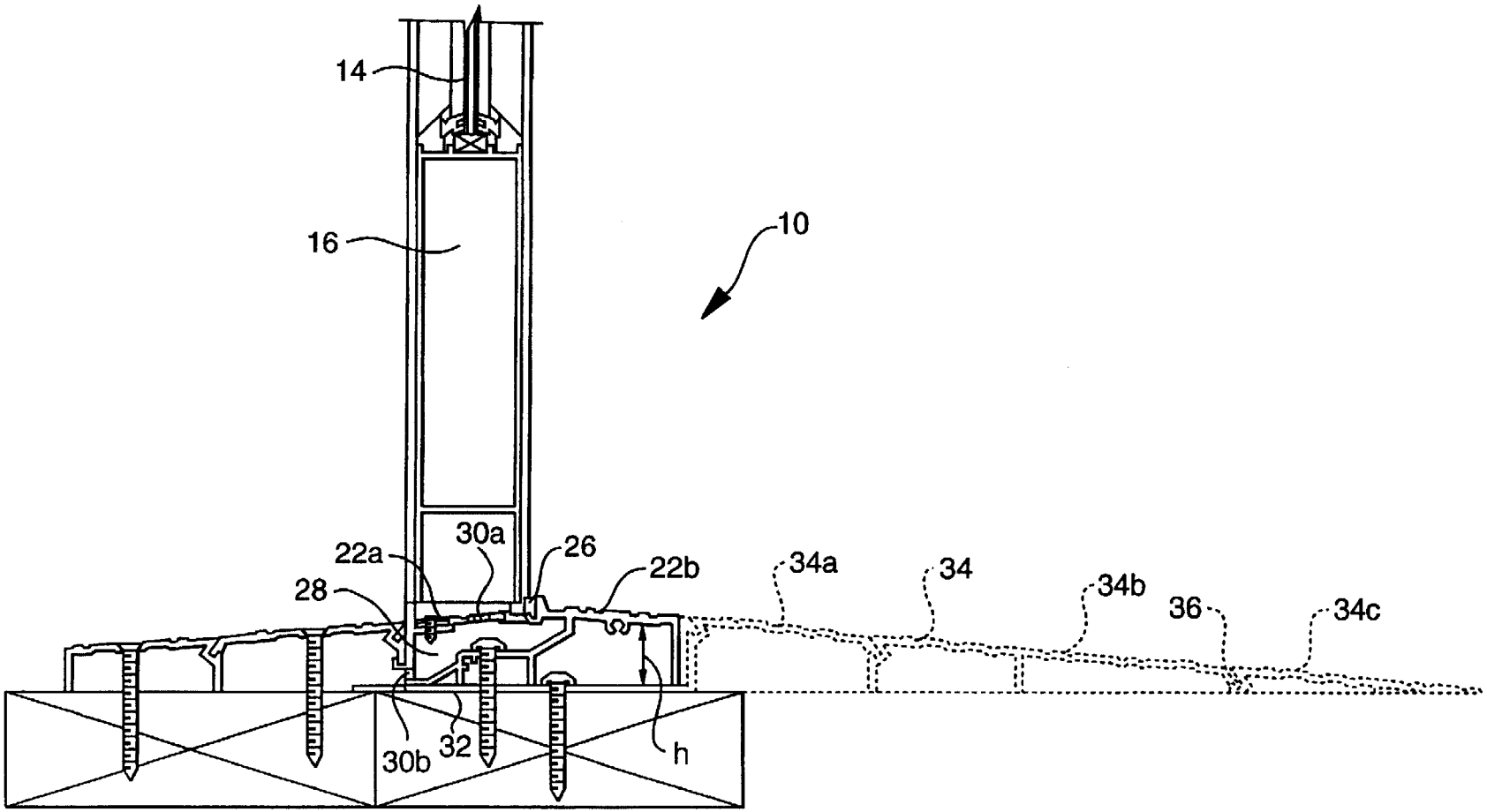
FIG. 2 is a cross-sectional side view of a first embodiment of a water resistant door assembly in accordance with the present invention.
Figure 3:
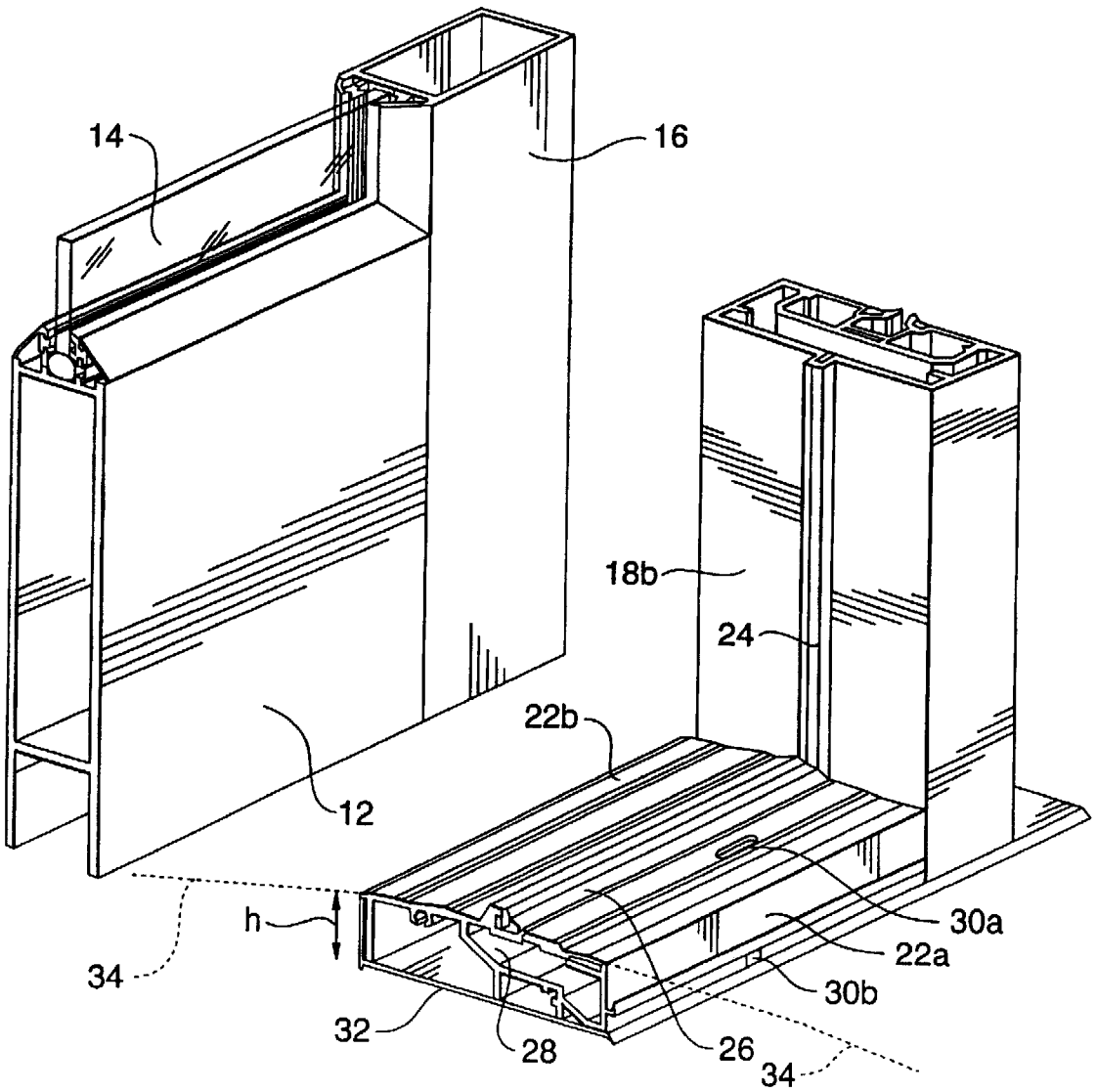
FIG. 3 is a partial perspective view of the embodiment depicted in FIG. 1, viewed from the exterior side of the door assembly.
Figure 4:
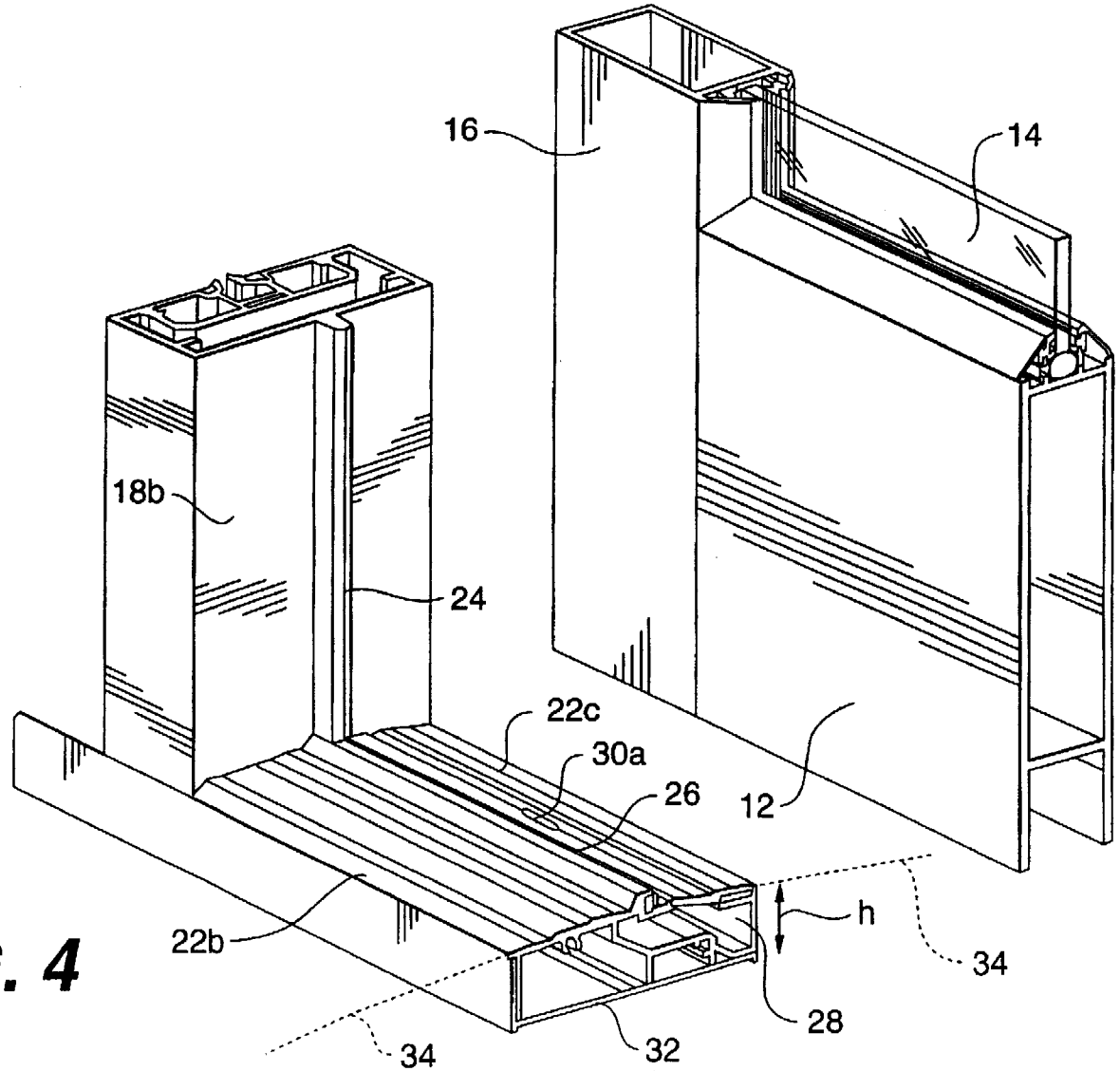
FIG. 4 is a partial perspective view of the embodiment depicted in FIG. 1, viewed from the interior side of the door assembly.

As broadly embodied herein, and referring to FIGS. 2–4, a vertical resilient weather-strip gasket 24 is provided extending the length of door jamb **18*b*. A horizontal resilient weather-strip gasket 26 also is provided running the width of threshold 22. In addition, a series of gutter troughs 28 are provided internal to threshold 22 with weep holes 30*a*, which communicate to the exterior side of the threshold and door assembly via exterior weep holes 30*b*. Finally, a continuous sill flashing 32 extends the width of threshold 22 beneath gutter trough 28. This structure is provided to act as a secondary barrier to water intrusion past door 12. Moisture or condensate attempting to bypass door 12 and raised threshold 22 will be stopped by gasket 26, flow through weep holes 30*a* and gutter trough 28, and exit to the exterior of the door assembly via weep holes 30*b***. Hence, the door assembly of the present invention provides both primary and secondary water resistance control at the critical threshold location.

As broadly embodied herein, the door assembly further includes a ramp 34, provided on both exterior and interior sides of the door. Ramp 34 can include a series of two, three, or more modular ramp portions **34*a*, 34*b*, 34*c*, and so on, containing tongue and groove interlocks 36 for easy assembly. Ramp 34** is sloped to facilitate easy ingress and egress through the door assembly, and preferably is sloped at approximately 1:12. This slope is provided in order to meet the existing requirements of the Americans With Disabilities Act, as well as existing building codes, rules, regulations. However,-the invention is not limited to such a slope. The precise slope may be altered to meet changing regulatory requirements.

The above description of the door assembly of the present invention was provided for the embodiment depicted in FIGS. 2–4, which represents a "shutter door" embodiment. The "shutter door" design is intended for installation with aftermarket conventional hurricane protection shutters, e.g., rollup corrugated shutters and the like, that are well-known in the art. The "shutter door" embodiment is designed to withstand the wind forces of the highest rated hurricanes and storms.

Figure 5:
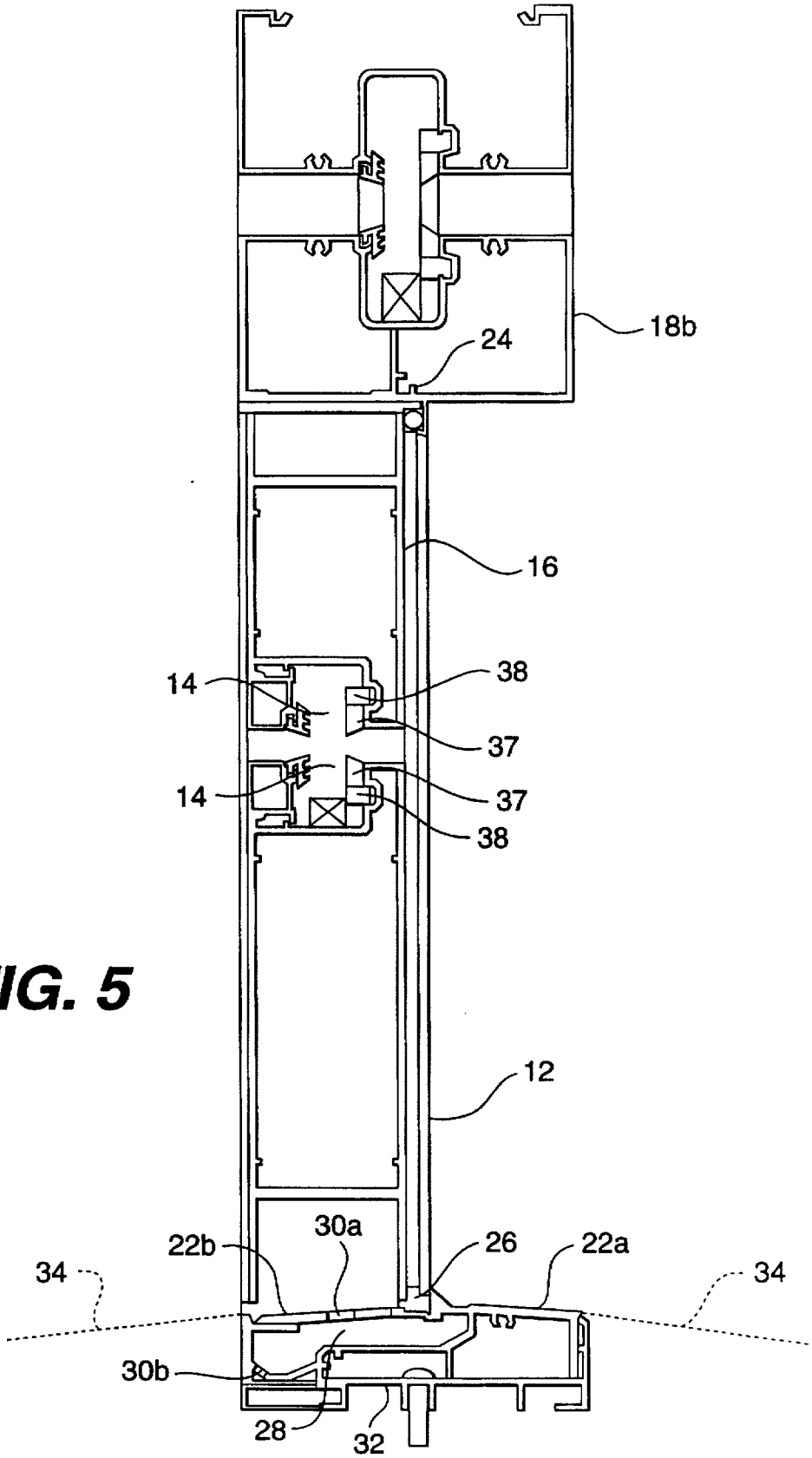
FIG. 5 is a cross-sectional side view of a second embodiment of a water resistant door assembly in accordance with the present invention.
Figure 6:
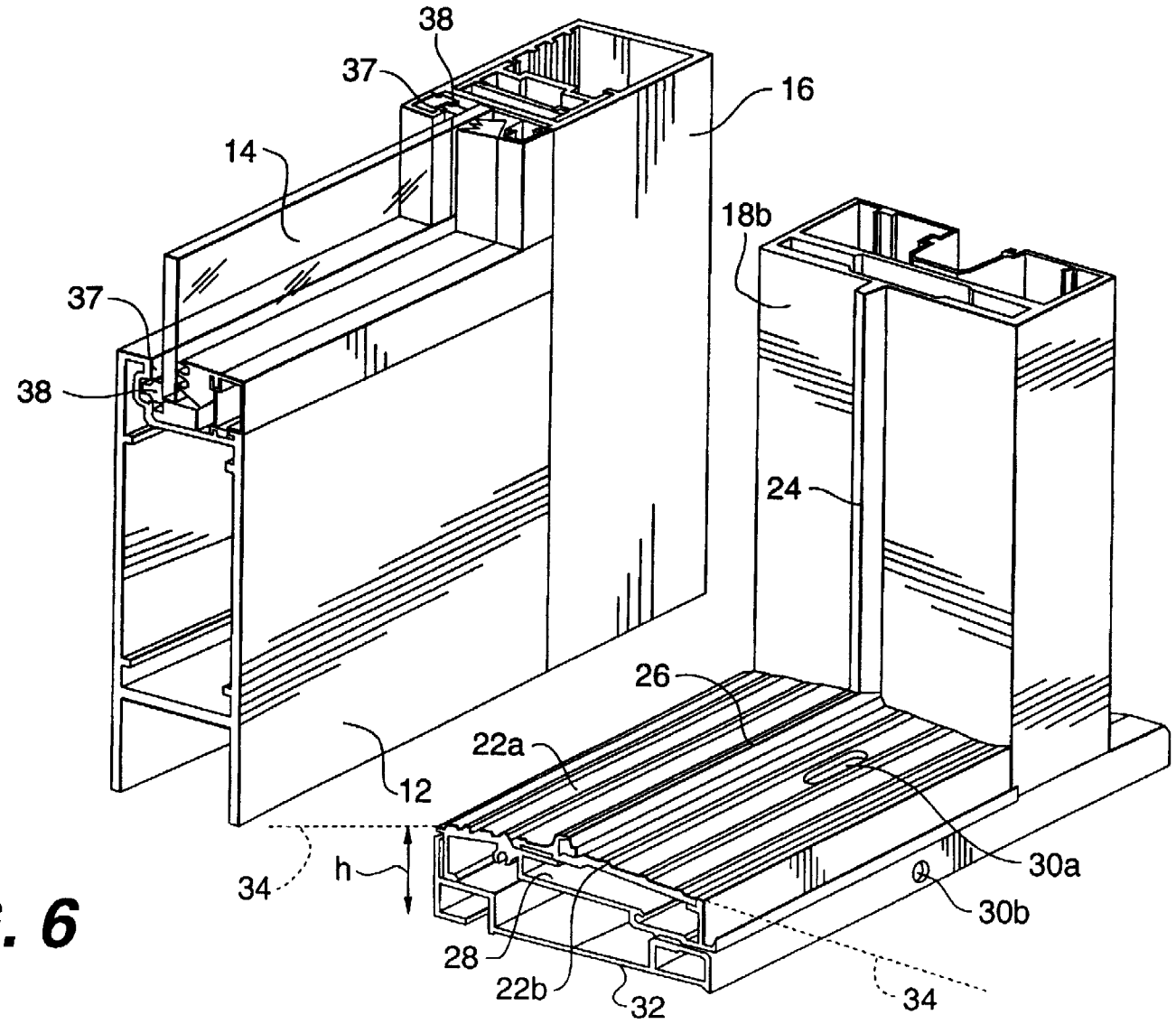
FIG. 6 is a partial perspective view of the embodiment depicted in FIG. 4, viewed from the exterior side of the door assembly.
Figure 7:
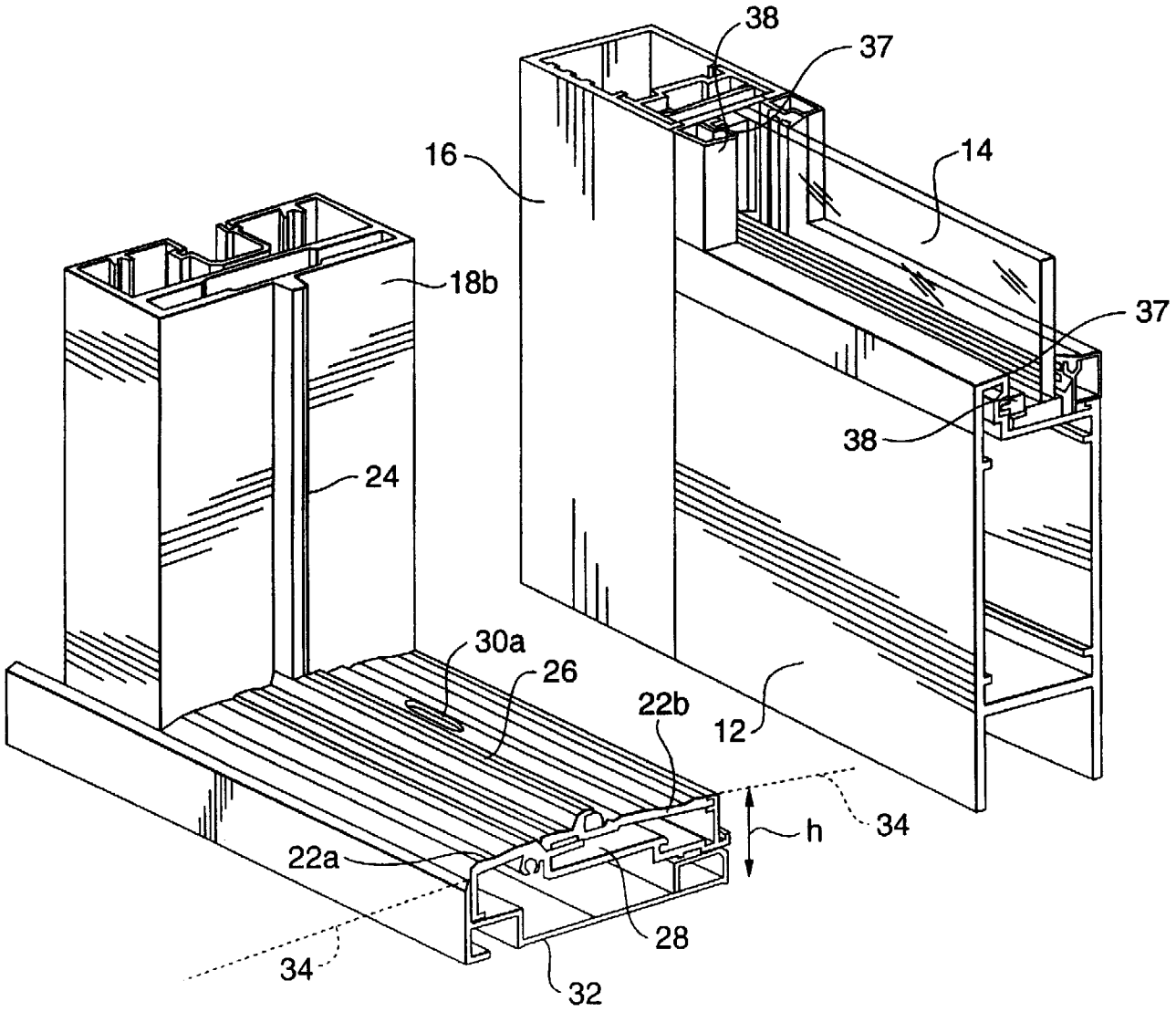
FIG. 7 is a partial perspective view of the embodiment depicted in FIG. 4, shown from inside the door assembly.

A second embodiment is depicted in FIGS. 5–7, which represents an "impact door" embodiment. The "impact door" embodiment contains the same water resistant features described above for the "shutter door" embodiment, and further includes a means for providing structural glazing support, and airborne debris impact resistance, which preferably includes structural silicone sealant glazing (SSG) 37, and resilient support block 38, alongside the peripheral edges of glazing unit 14.

The "impact door" embodiment is designed to resist the impact of a nine (9) pound minimum two-by-four inch board or similar object travelling at various specified velocities, as well as cyclic wind forces of the highest rated hurricanes and storms.

Although the present invention has been described in terms of the preferred embodiments above, numerous modifications and/or additions to the above-described embodiments will be apparent to one skilled in the art without departing from the spirit or scope of the invention. For example, the raised threshold, gaskets, gutter troughs and weep holes of the invention could be used on a sliding door, a window, or the like. The scope of the present invention is limited solely by the claims set forth below, and their equivalents.

We claim:

1. A water resistant door assembly, comprising a door frame having an interior side and an exterior side;

a door hingedly mounted within said frame, said door having an interior side and an exterior side;

a threshold attached to a lower portion of said frame, the threshold having a height selected to be equal to or greater than a water head at a preselected design wind load pressure;

a gasket provided in said threshold for sealing said door, said gasket defining a boundary between the interior and exterior sides of said door frame;

a gutter trough within said threshold; and a first weep hole positioned on a first portion of said threshold, and a second weep hole positioned on a second portion of the threshold lower than said first portion, said first and second weep holes being positioned on the exterior side of said door frame and in continuous flow communication with one another on the exterior of said door via said gutter trough.

2. A water resistant door assembly according to claim 1, wherein said door is an out-swinging door.

3. A water resistant door assembly according to claim 2, wherein said threshold is attached to the door frame proximate the interior side of the door.

4. A water resistant door according to claim 1, wherein the water head is calculated as 0.192×water resistance pressure, the water resistance pressure is calculated as 0.15×design wind load pressure, and the design wind load pressure is calculated as 0.00256×the square of a preselected design wind velocity.

5. A water resistant door according to claim 1, wherein said threshold includes a ramp having a slope of approximately 1:12.

6. A water resistant door assembly according to claim 1, wherein said first weep hole is positioned on an upper surface of said threshold, and said second weep hole is positioned on a side surface of said threshold.

7. A water resistant door assembly according to claim 1, wherein said threshold includes a sill flashing extending the width of said threshold beneath said gutter trough, and said first and second weep holes are in flow communication with one another via said gutter trough and said sill flashing.

8. A water resistant door assembly according to claim 1, wherein said threshold includes a plurality of first and second weep holes.

* * * * *